US007513841B2

(12) United States Patent
Clifford

(10) Patent No.: US 7,513,841 B2
(45) Date of Patent: Apr. 7, 2009

(54) RECREATION RANGE

(76) Inventor: Nicholas Guy Clifford, 16/3 East Crescent Street, Mcmahons Point, NSW 2060 (AU)

( * ) Notice: Subject to any disclaimer, the term of this patent is extended or adjusted under 35 U.S.C. 154(b) by 347 days.

(21) Appl. No.: 10/523,436

(22) PCT Filed: Jul. 29, 2003

(86) PCT No.: PCT/AU03/00949

§ 371 (c)(1),
(2), (4) Date: Aug. 15, 2005

(87) PCT Pub. No.: WO2004/011108

PCT Pub. Date: Feb. 5, 2004

(65) Prior Publication Data

US 2006/0121996 A1 Jun. 8, 2006

(30) Foreign Application Priority Data

Jul. 29, 2003 (AU) ..... 2002950433

(51) Int. Cl.
*A63B 69/00* (2006.01)

(52) U.S. Cl. ..... 473/451; 473/22; 52/6; 52/66

(58) Field of Classification Search ..... 473/451, 473/153, 159, 137; 104/44; D21/790; 52/7, 52/8, 9, 6, 66; 273/352; 472/29–42
See application file for complete search history.

(56) References Cited

U.S. PATENT DOCUMENTS

| | | | | | |
|---|---|---|---|---|---|
| 3,091,815 | A | * | 6/1963 | Krawiec | 52/31 |
| 3,366,388 | A | * | 1/1968 | Del Raso | 473/153 |
| 3,708,173 | A | * | 1/1973 | Hewson, Jr. | 473/153 |
| 3,862,760 | A | * | 1/1975 | Davis | 473/159 |
| 4,560,165 | A | * | 12/1985 | Witteman et al. | 473/269 |
| 4,767,117 | A | * | 8/1988 | Maio | 273/352 |
| 4,846,478 | A | * | 7/1989 | Saint-Cricq | 473/153 |
| 5,171,016 | A | | 12/1992 | Kamal | |
| 5,234,215 | A | * | 8/1993 | Uehara | 473/168 |
| 5,505,452 | A | * | 4/1996 | Meaden | 473/154 |
| 5,683,304 | A | * | 11/1997 | Bunyi | 473/132 |
| 5,743,815 | A | * | 4/1998 | Helderman | 473/353 |

FOREIGN PATENT DOCUMENTS

WO WO 02/07827 A1 1/2002

* cited by examiner

*Primary Examiner*—Gene Kim
*Assistant Examiner*—M Chambers
(74) *Attorney, Agent, or Firm*—Knobbe, Martens, Olson & Bear LLP

(57) ABSTRACT

A recreation range system (10) including a field (11) and a rotatable range carousel (13).

19 Claims, 4 Drawing Sheets

RECREATION RANGE

RELATED APPLICATIONS

This application is the U.S. National Phase of PCT/AU2003/000949 filed Jul. 29, 2003 and claims priority to Australian Application No. 2002950433 filed Jul. 29, 2002, which are hereby incorporated by reference herein.

The present invention relates to facilities adapted for activities related to aspects of sport and, in particular, where elements of a particular sport may be practiced for amusement or personal improvement.

BACKGROUND

Facilities specifically adapted to the practice of either all or some of the aspects of a particular sport are known. For example bowling alleys and bowling greens provide such facilities where all aspects of the games of pin and lawn bowling may be performed. Examples of facilities providing for the practice of certain aspects of a game are mini golf ranges, putting greens and golf driving ranges.

In the latter example, players are provided with a play station or position where golf balls and other equipment is provided together with amenities so as to allow a player to practice a variety of golf strokes in a convenient environment.

Such facilities are not available for large ball games such as for example the game of soccer. Practice of this particular game for example can only be performed in a sufficiently open space where for a single player ball return becomes at least tedious. As well there is little variation possible, particularly for an individual wishing to improve his or her ball skills, either for amusement or for serious practice.

It is an object of the present invention to address or ameliorate at least one of the above disadvantages.

BRIEF DESCRIPTION OF INVENTION

Accordingly, in one broad form of the invention there is provided a recreation range system including a field and a rotatable range carousel.

Preferably said range carousel is provided with at least one player level wherein the periphery of said player level is divided into a plurality of player lanes, said player lanes provided with ball delivery means and said field provided with ball retrieval means.

Preferably the periphery of said field is provided with a plurality of target structures.

Preferably said carousel is offset from the center of said field.

Preferably said field slopes downwardly from said carousel to said periphery of said field.

Preferably said field is constructed as a suspended surface overlying a substantially dished subsurface.

The recreation range system of claim 1 wherein said carousel is provided with two player levels; an upper level and a lower level arranged one above the other around a central support column.

Preferably said central support column is rotatably supported, said column and said carousel adapted to be urged in circular motion by a power source acting through a drive train.

Preferably said ball delivery means and said ball retrieval means are adapted to process a range of ball sizes.

Preferably said ball delivery means and said ball retrieval means are provided with a plurality of balls, each of said balls provided with a unique electronically readable ball recognition code.

Preferably said ball retrieval means is adapted to return balls from the periphery of said field to said central support column.

Preferably said ball retrieval means includes a plurality of ball collection troughs disposed around the periphery of said field, each of said collection troughs communicating with said central support column by underground shafts sloping downwardly from said periphery towards said central support column.

Preferably said ball retrieval means includes a plurality of openings along the periphery of said field, said openings allowing balls to drop to said dished subsurface.

Preferably said ball delivery means is provided with a ball collections and sorting chamber adapted to sort said ball sizes and deliver sorted balls to designated said player lanes.

Preferably a player urges a ball to follow a trajectory from one of said player lanes in a generally radial direction from said range carousel towards said periphery of said field.

Preferably a ball urged by said player from said player lane towards said periphery of said field is tracked electronically.

Preferably said target structures are adapted to display a variety of target images.

Preferably said target images are provided with electronic sensor means adapted to record the impact of a ball and the recognition code of said ball.

Preferably said target images are associated with a point credit system, said credit system adapted to award credit points to a player when a ball urged by said player strikes said target image.

Preferably said field may be adapted to display a number of target areas, said target areas provided with sensors to detect the impact of a ball and the recognition code of said ball.

Preferably said credit points accruing to a player are electronically displayed on display means at the player lane used by said player.

Preferably said credit points accrued to a player during a player session are stored in a central database storage facility as a score, said score being available for retrieval from said database for display at subsequent player sessions.

Preferably said scores stored in said database storage facility are available for printout.

Preferably said scores are associated with a prize conferring system.

Preferably said field is provided with a plurality of ball mortars arranged radially and at various distances from the center of said range carousel, said ball mortars adapted to urge a ball into any one of a range of specified trajectories, said trajectories ending in the area of a player lane.

Preferably said trajectories are adapted to present a ball to a said player on said player lane simulating a range of ball approaches to a player as experienced in a game of soccer.

Preferably said ball retrieval means is adapted to provide said balls on demand to said ball mortars.

Preferably said carousel is provided with amenities, said amenities including a kiosk.

Preferably said upper player level is provided with a safety net extending radially outward from the periphery of said player level.

In a further broad form of the invention there is provided a method for operating a recreation range, said recreation range including a field and a rotatable range carousel, said range carousel provided with at least one player level wherein the periphery of said player level is divided into a plurality of player lanes, said player lanes provided with ball delivery means and said field provided with ball retrieval means; said method comprising conveying players on a arcuate path over a portion of said range.

Preferably said field is of generally ovoid shape.

Preferably the periphery of said field is provided with a plurality of target structures.

Preferably said carousel is offset from the center of said ovoid shape.

Preferably the surface of said field slopes downwardly from said carousel to said periphery of said field.

Preferably said field is constructed as a suspended surface overlying a substantially dished subsurface.

Preferably said carousel is provided with two player levels; an upper level and a lower level arranged one above the other around a central support column.

Preferably said central support column is rotatably supported, said column and said carousel adapted to be urged in circular motion by a power source acting through a drive train.

Preferably said ball delivery means and said ball retrieval means are adapted to process a range of ball sizes.

Preferably said ball delivery means and said ball retrieval means are provided with a plurality of balls, each of said balls provided with a unique electronically readable ball recognition code.

Preferably said ball retrieval means is adapted to return balls from the periphery of said field to said central support column.

Preferably said ball retrieval means includes a plurality of ball collection troughs disposed around the periphery of said field, each of said collection troughs communicating with said central support column by underground shafts sloping downwardly from said periphery towards said central support column.

Preferably said ball retrieval means includes a plurality of openings along the periphery of said field, said openings allowing balls to drop to said dished subsurface.

Preferably said ball delivery means is provided with a ball collections and sorting chamber adapted to sort said ball sizes and deliver sorted balls to designated said player lanes.

Preferably a player urges a ball to follow a trajectory from one of said player lanes in a generally radial direction from said range carousel towards said periphery of said field.

Preferably a ball urged by said player from said player lane towards said periphery of said field is tracked electronically.

Preferably said target structures are adapted to display a variety of target images.

Preferably said target images are provided with electronic sensor means adapted to record the impact of a ball and the recognition code of said ball.

Preferably said target images are associated with a point credit system, said credit system adapted to award credit points to a player when a ball urged by said player strikes said target image.

Preferably said field may be adapted to display a number of target areas, said target areas provided with sensors to detect the impact of a ball and the recognition code of said ball.

Preferably said credit points accruing to a player are electronically displayed on display means at the player lane used by said player.

Preferably said credit points accrued to a player during a player session are stored in a central database storage facility as a score, said score being available for retrieval from said database for display at subsequent player sessions.

Preferably said scores stored in said database storage facility are available for printout.

Preferably said scores are associated with a prize conferring system.

Preferably said field is provided with a plurality of ball mortars arranged radially and at various distances from the center of said range carousel, said ball mortars adapted to urge a ball into any one of a range of specified trajectories, said trajectories ending in the area of a player lane.

Preferably said trajectories are adapted to present a ball to a said player on said player lane simulating a range of ball approaches to a player as experienced in a game of soccer.

Preferably said ball retrieval means is adapted to provide said balls on demand to said ball mortars.

Preferably said carousel is provided with amenities, said amenities including a kiosk.

Preferably said ball retrieval means is adapted to provide said balls on demand to said ball mortars.

Preferably said upper player level is provided with a safety net extending radially outward from the periphery of said player level.

BRIEF DESCRIPTION OF THE DRAWINGS

Embodiments of the present invention will now be described with reference to the accompanying drawings wherein.

DETAILED DESCRIPTION OF PREFERRED EMBODIMENTS

A first preferred embodiment of a recreation range 10 according to the invention will now be described with reference to FIGS. 1 to 3.

Figure 1:
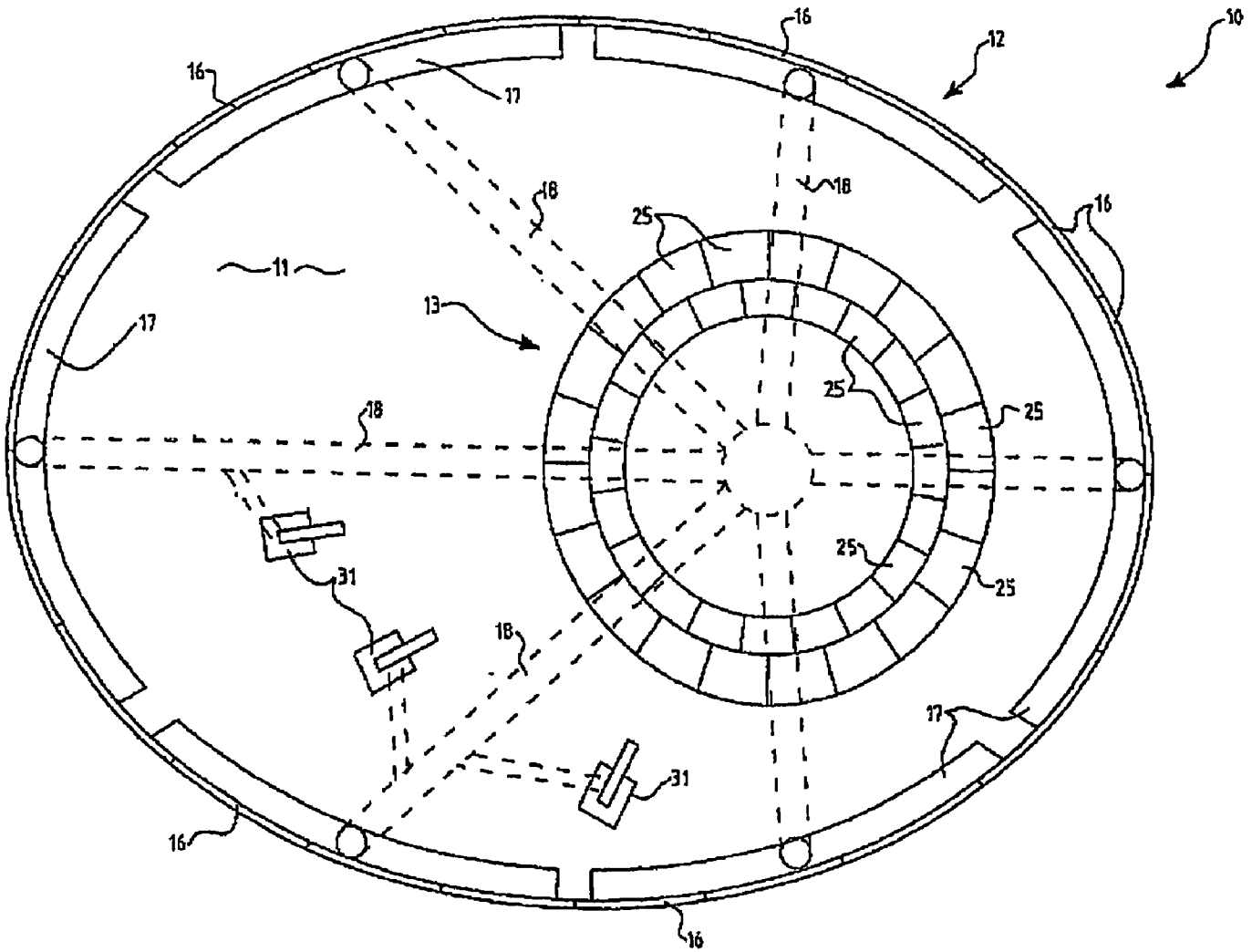
FIG. 1 is a plan view of recreation range according to a preferred embodiment of the invention.

Accordingly in FIG. 1 is shown a field 11 of ovoid shape with periphery 12 and range carousel 13 offset from the field center. Preferably range carousel 13 is located at a somewhat higher level than the periphery 12 so that the surface 14 of field 11 slopes downwardly towards the periphery 12, the slope being sufficient to allow a ball 15 to roll towards periphery 12.

Arranged around periphery 12 of field 11 are target structures 16. Also arranged around periphery 12 are ball collection troughs 17 provided with underground shafts 18 sloping downwardly to the center of range carousel 13 to provide ball retrieval means. Range carousel 13 is offset from the field center so as to give as wide a range of distances as possible from the carousel 13 to the target structures 16 at field periphery 12.

Figure 4:
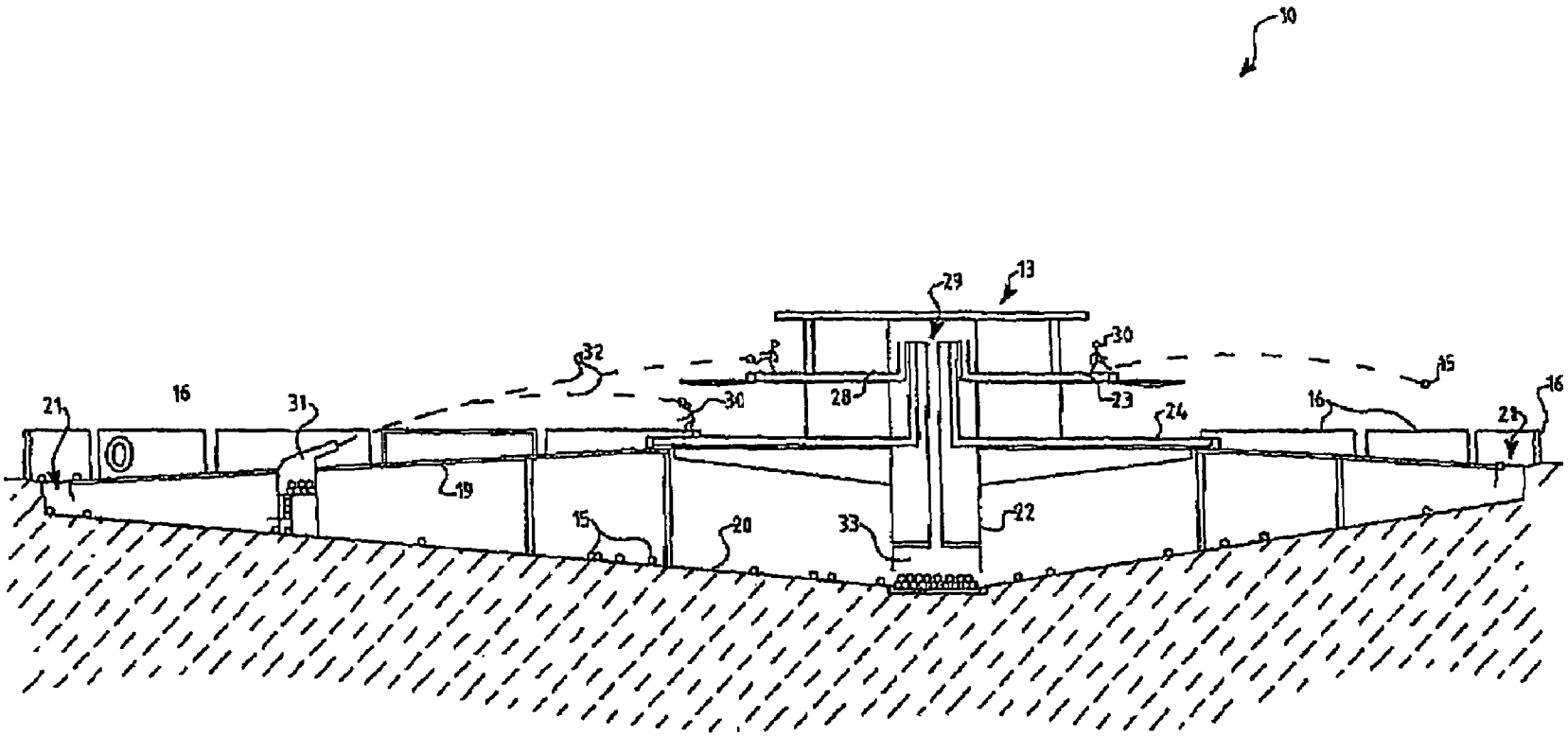
FIG. 4 is a sectioned elevation view of a further preferred embodiment of the invention.

In an alternative preferred embodiment illustrated in FIG. 4, the field 11 is constructed as a suspended surface 19 overlying a dished subsurface 20 where the subsurface 20 rises from the center of range carousel 13 to the periphery 32 of the field 11. Peripheral openings 21 in the suspended field surface 18 allow for the entry of balls 15, these balls then rolling down the dished subsurface to collect at the central support column 22 of range carousel 13.

Figure 2:
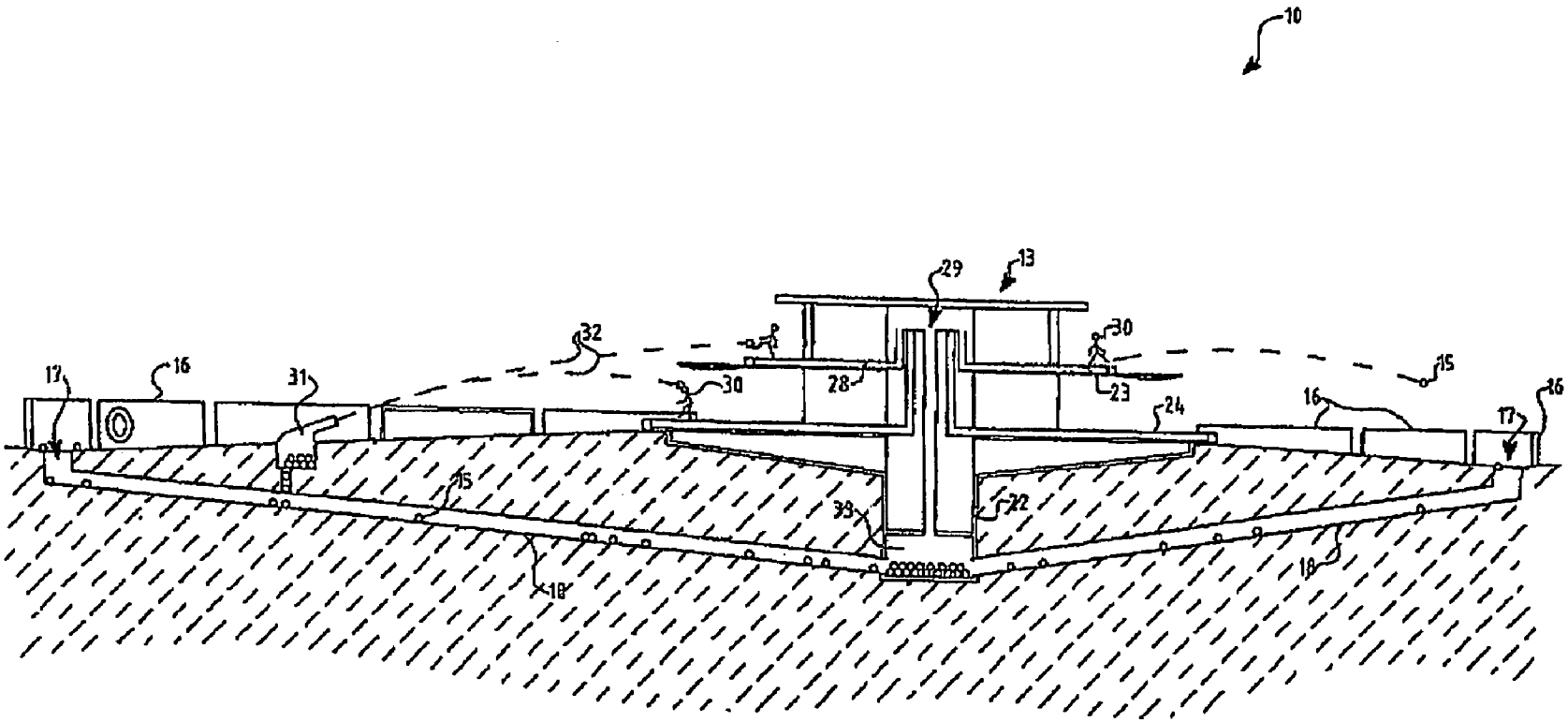
FIG. 2 is a sectioned elevation view of the recreation range of FIG. 1.
Figure 3:
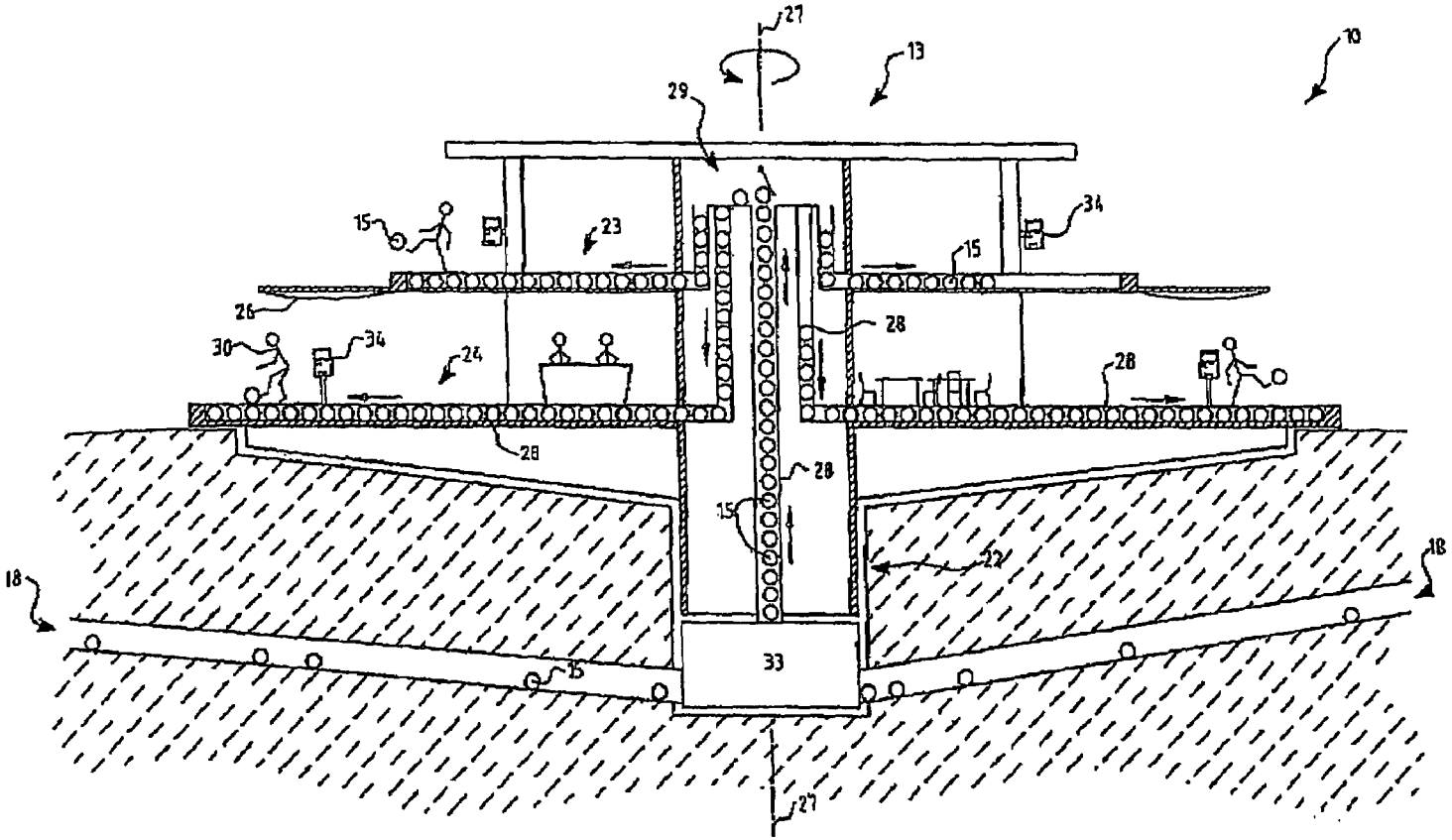
FIG. 3 is an enlarged portion of the section elevation view of FIG. 2.

In a preferred embodiment as shown in FIGS. 2 and 3 range carousel 13 is constructed with two player levels, upper level 23 and lower level 24 forming circular discs around central support column 22. The outer annular segment of each player level is divided into a plurality of player lanes 25 as may best be seen in FIG. 1. Upper level 23 is further provided with annular safety net 26 extending outwardly from its periphery.

Range carousel 13 is rotatably supported on bearings and driven by a suitable power source and drive train (not shown) to rotate the carousel about its central axis 27. Thus each player lane 25 is brought into alignment with every target structure 16 and any other feature of field 11 once every revolution of range carousel 13.

Each player lane 25 is provided with a ball delivery means 28 fed from a central ball distribution system 29 located in central support column 22. In a preferred embodiment, at least three sizes of balls 15 may be selected by a player 30 so as to allow for players from young children to adults.

As well as being able to select a ball from the ball delivery means 28 of the range carousel 13, a player 30 may elect to be passed a ball from any one of a number of ball mortars 31 disposed at various distances from the range carousel 13 and generally radial to its center. The manner of the pass is further selectable by a player 30 so that the trajectory 32 and delivery of the ball 15 by the ball mortar 31 may simulate a variety of typical passes such as experienced in the game of soccer. Thus by means of the two methods of ball supply, a player may for example elect to kick a placed ball, kick a ball on the volley, "head" or "chest" a ball.

Balls 15 kicked or otherwise ejected by players 30 from the range carousel 13 may hit one of the target structures 16 at the field periphery 12 or fall short onto the sloping surface 14 or 19 of the field 11. In either case a used ball 15 will roll into a ball collection trough 17 or peripheral opening 21 and subsequently into its associated underground shaft 18 or onto subsurface 20 to thence roll downwardly to the central support column 22 of the range carousel 13.

Located in the base of the central support column 22 is ball collection and sorting chamber 33. For clarity FIG. 3 shows only a single size ball distribution system 29 but separate distribution pathways are provided for each size of ball offered for play. After sorting in chamber 33 balls 15 are raised to the upper level 23 for further distribution to the player lanes 25 on each player level.

Balls are provided sequentially for the duration of a playing session. In one preferred embodiment a playing session is limited to one revolution of the range carousel.

All balls are provided with a unique electronically readable recognition code. Target structures 16 are in this embodiment provided with a variety of target images which are fitted with sensors adapted to register the impact and recognition code of a ball. Sensors are associated with particular target images so that a point crediting system may award points to a player whose ball impacts a particular target image. Points gained by a player during a playing session are accrued to accord a score to the player. The score so gained is stored in a central database facility for subsequent retrieval if desired. Thus a players may play for the highest score among a group of players or an individual player may attempt to better his previous score in subsequent playing sessions.

To allow a player to select a method of play (ball from range carousel delivery means or from a ball mortar) and as a means of communicating a target hit and any points scored, each player lane is provided with a player terminal 34. Player terminals are provided with selection input means and score display means. Optionally terminals could also function as fee collection stations to allow a player to make deposits of playing fees for as many playing sessions as he or she wishes to play. Optionally terminals may include a printing means so as to provide a player with a printed record of the game played and the points and score attained.

In a further preferred embodiment the surface of field 11 may be provided with a number of demarcated areas in the vicinity of the range carousel, these areas provided with impact and coded registering sensors so as to allow players to practice heading or high kicking a ball with accuracy to land on a selected demarcated area.

Clearly the basic recreation range herein described may be adapted in various ways to provide additional interest to players as well as providing additional revenue streams to the recreation range operator. Thus by way of example, certain target images or accrued scores may be associated with special prizes; target structures may be adapted to carry advertising for products and the range carousel could be provided with kiosk facilities.

The invention claimed is:

1. A recreation range system including a field and a rotatable range carousel arranged thereon wherein, said range carousel is provided with at least one player level wherein a periphery of said player level is divided into a plurality of player lanes, said player lanes provided with ball delivery means and said field provided with ball retrieval means, wherein said ball retrieval means is adapted to return balls from the periphery of said field to a central support column and wherein the range system is configured such that a player urges a ball to follow a trajectory from one of said player lanes in a generally radial direction from said range carousel towards said periphery of said field.

2. The recreation range system of claim 1 wherein the periphery of said field is provided with a plurality of target structures.

3. The recreation range system of claim 2 wherein said carousel is offset from the center of said field.

4. The recreation range system of claim 3 wherein the surface of said field slopes downwardly from said carousel to said periphery of said field.

5. The recreation range system of claim 4 wherein said field is constructed as a suspended surface overlying a substantially dished subsurface.

6. The recreation range system of claim 1 wherein said carousel is provided with two player levels; an upper level and a lower level arranged one above the other around a central support column.

7. The recreation range system of claim 6 wherein said central support column is rotatably supported, said column and said carousel adapted to be urged in circular motion by a power source acting through a drive train.

8. The recreation range system of claim 7 wherein said ball delivery means and said ball retrieval means are adapted to process a range of ball sizes.

9. The recreation range system of claim 8 wherein said ball delivery means and said ball retrieval means are provided with a plurality of balls, each of said balls provided with a unique electronically readable ball recognition code.

10. The recreation range system of claim 1 wherein said ball retrieval means includes a plurality of ball collection troughs disposed around the periphery of said field, each of said collection troughs communicating with said central support column by underground shafts sloping downwardly from said periphery towards said central support column.

11. The recreation range system of claim 10 wherein said ball delivery means is provided with a ball collections and sorting chamber adapted to sort said ball sizes and deliver sorted balls to designated said player lanes.

12. The recreation range system of claim 1 wherein said ball retrieval means includes a plurality of openings along the periphery of said field, said openings allowing balls to drop to said dished subsurface.

13. The recreation range system of claim 1 wherein a ball urged by said player from said player lane towards said periphery of said field is tracked electronically.

14. The recreation range system of claim 13 wherein said target structures are adapted to display a variety of target images.

15. The recreation range system of claim 14 wherein said target images are provided with electronic sensor means adapted to record the impact of a ball and the recognition code of said ball.

16. The recreation range system of claim 15 wherein said target images are associated with a point credit system, said credit system adapted to award credit points to a player when a ball urged by said player strikes said target image.

17. The recreation range system of claim 16 wherein said field may be adapted to display a number of target areas, said target areas provided with sensors to detect the impact of a ball and the recognition code of said ball.

18. The recreation range system of claim 17 wherein said credit points accruing to a player are electronically displayed on display means at the player lane used by said player.

19. A recreation range system comprising:

a field wherein the field is provided with ball retrieval means; and a rotatable range carousel arranged on the field wherein the range carousel is provided with at least one player level and wherein a periphery of the player level is divided into a plurality of player lanes and wherein the player lanes are provided with ball delivery means wherein said carousel is provided with two player levels, an upper level and a lower level arranged one above the other around a central support column, wherein said central support column is rotatably supported, and wherein the column and the carousel are adapted to be urged in circular motion by a power source acting through a drive train wherein the ball delivery means and the ball retrieval means are adapted to process a range of ball sizes and wherein the ball delivery means and the ball retrieval means are provided with a plurality of balls, wherein each of the balls is provided with a unique electronically readable ball recognition code and wherein the ball retrieval means is adapted to return balls from the periphery of the field to the central support column.

* * * * *

UNITED STATES PATENT AND TRADEMARK OFFICE

CERTIFICATE OF CORRECTION

PATENT NO. : 7,513,841 B2
APPLICATION NO. : 10/523436
DATED : April 7, 2009
INVENTOR(S) : Nicholas Guy Clifford It is certified that error appears in the above-identified patent and that said Letters Patent is hereby corrected as shown below:

Title Page 1 (Item 30), Line 1 - Please delete "Jul. 29, 2003" and insert therefore, --Jul. 29, 2002--.

Column 4, Line 59 - Please delete "32" and insert therefore, --12--.

Signed and Sealed this

Twenty-second Day of December, 2009

David J. Kappos

David J. Kappos
*Director of the United States Patent and Trademark Office*